US009414721B2

(12) United States Patent
Marin-Quintero et al.

(10) Patent No.: US 9,414,721 B2
(45) Date of Patent: Aug. 16, 2016

(54) SYSTEM FOR DISPENSING NON-INTERTWINED WET WIPES IN A RIGID CONTAINER

(71) Applicant: Grupo P.I. Mabe, S.A. de C.V., Puebla (MX)

(72) Inventors: Manuel de Jesus Marin-Quintero, Puebla (MX); Bernardo Fajardo-Eslava, Puebla (MX); Juan Miguel Martini-Merlo, Puebla (MX); Lucia del Carmen Sanchez-Fernandez, Puebla (MX); Carlos Canales-Espinosa De Los Monteros, Puebla (MX)

(73) Assignee: GRUPO P.I. MABE, S.A. DE C.V. (MX)

( * ) Notice: Subject to any disclaimer, the term of this patent is extended or adjusted under 35 U.S.C. 154(b) by 0 days.

(21) Appl. No.: 14/518,634

(22) Filed: Oct. 20, 2014

(65) Prior Publication Data

US 2015/0108157 A1 Apr. 23, 2015

(30) Foreign Application Priority Data

Oct. 22, 2013 (MX) ..... MX/a/2013/012340

(51) Int. Cl.

| | |
|---|---|
| ***B65H 3/00*** | (2006.01) |
| ***A47K 10/42*** | (2006.01) |
| ***A47K 10/44*** | (2006.01) |
| *A47K 10/32* | (2006.01) |

(52) U.S. Cl.

CPC ..... *A47K 10/421* (2013.01); *A47K 10/44* (2013.01); *A47K 2010/3233* (2013.01); *A47K 2010/3266* (2013.01)

(58) Field of Classification Search

CPC ..... A47K 10/42; A47K 10/421; A47K 10/44; A47K 2010/3266; A47K 2010/3233

USPC ..... 221/55, 259, 36, 37, 247, 210, 255

See application file for complete search history.

(56) References Cited

U.S. PATENT DOCUMENTS

| | | | | | |
|---|---|---|---|---|---|
| 1,730,126 | A | * | 10/1929 | Dailey | A47K 10/44 221/210 |
| 2,071,981 | A | * | 2/1937 | Landsiedel | B65D 83/0835 221/210 |
| 2,588,152 | A | * | 3/1952 | Newman | B42D 3/12 221/199 |
| 2,885,112 | A | | 5/1959 | Willat | |
| 3,094,323 | A | * | 6/1963 | Catania | A45D 2/127 221/210 |

(Continued)

*Primary Examiner* — Rakesh Kumar

(74) *Attorney, Agent, or Firm* — James P. Muraff; Neal, Gerber & Eisenberg LLP

(57) ABSTRACT

The present invention refers to a rigid container for dispensing wet wipes that has a stack of non-intertwined wet wipes inside, and has an opening on its top surface covered by a lid coupled to said container. In this invention, the lid has at least one fastening device on its inner surface. Said fastening device has a first end permanently attached to the inner surface of the lid and has a mechanical element in a second end distant to the first end designed to be attached to the top wet wipe of the stack. Thus, the present invention provides a rigid container with a system for dispensing non-intertwined wet wipes contained therein, wherein only the top wet wipe of the stack contained inside the container is dispensed.

13 Claims, 4 Drawing Sheets

(56) References Cited

U.S. PATENT DOCUMENTS

| | | | | | |
|---|---|---|---|---|---|
| 3,248,006 | A | | 4/1966 | Andrew | |
| 3,276,622 | A | * | 10/1966 | Krzyzanowski | A47K 10/421 206/494 |
| 4,121,726 | A | * | 10/1978 | Pemberton | A47J 31/08 221/213 |
| 4,214,673 | A | * | 7/1980 | Heath | B65D 83/0835 221/259 |
| 4,417,670 | A | | 11/1983 | Booher | |
| 4,629,092 | A | * | 12/1986 | English | A47J 31/08 221/247 |
| 5,097,984 | A | * | 3/1992 | Meisner | A47J 31/08 221/210 |
| 5,197,630 | A | * | 3/1993 | Kirla | A47J 31/08 221/210 |
| 5,687,876 | A | * | 11/1997 | Lucas, Jr. | A47J 31/08 221/259 |
| 5,810,200 | A | | 9/1998 | Trokhan | |
| 7,428,978 | B2 | * | 9/2008 | Lewis | B65H 3/56 221/151 |
| 2012/0187140 | A1 | | 7/2012 | Nasrallah | |
| 2015/0108157 | A1 | * | 4/2015 | Marin-Quintero | A47K 10/44 221/55 |

* cited by examiner

SYSTEM FOR DISPENSING NON-INTERTWINED WET WIPES IN A RIGID CONTAINER

CROSS-REFERENCE TO RELATED APPLICATION

This application claims priority to Mexican Patent Application No. MX/a/2013/012340, filed on Oct. 22, 2013, the content of which is fully incorporated herein by reference.

TECHNICAL FIELD OF THE INVENTION

The present invention refers to the technical field of containers for storing personal hygiene products. Particularly, the invention refers to rigid containers for storing, containing, transporting, dispensing and maintaining the features of the wet wipes.

BACKGROUND OF THE INVENTION

There is currently a plurality of container devices for disposable hygienic products such as tissues, wet wipes, face towels and similar products. The known containers and dispenser devices may be manufactured in rigid or flexible plastic material, cardboard, heavyweight paper or other materials that provide the structural characteristics required to the container. Some of these containers have hinged lids with mechanical or adhesive sealing to keep the moisture of the product. However, most of these containers have the disadvantage of not possessing elements for dispensing the products during its use, however, there are some patent documents in the prior art related to rigid containers with elements to dispense tissue-type paper products or wet wipes.

For example, U.S. Pat. No. 2,885,112 describes a cardboard container for non-intertwined tissues, having a top opening in the container which gives access to the tissues. The invention consists of a hinged flange which is pivoted at the inner wall opposed to the opening that remains in a straight horizontal position near the top face of the container. The flange has also an adhesive mean portion in its distal end. The invention works when a user presses the flange from its straight down position until the adhesive mean portion contacts the top tissue of the stack, lifting it towards the user when the flange returns to the straight position. Therefore, this patent has the disadvantage that the container has no lid, so the tight sealing would not be retained in case it should contain wet wipes. Another disadvantage refers to the fact that the use of adhesive means for lifting wipes does not provide the appropriate fastening strength in the wet wipes. Finally, this patent has the disadvantage that the user must press the finger against the flange inside the container so the pivot of the flange can fail due to the mechanical fatigue resulting from the excessive pressure of the user.

Furthermore, U.S. Pat. No. 3,094,323 describes a rigid container for storing non-intertwined tissues, which has a hinged lid allowing access to the tissues through all its top surface. Further, the lid has a hinged frame by one of its sides at the distal end of the spring-loaded lid. The frame comprises adhesive means in its distal side. While the hinged lid is in the closed position, the frame rests on the top tissue of the stack due to the spring means action. In use, the user lifts the hinged lid and the frame grabs the top tissue of the stack by the adhesive means. When lifting the hinged lid up to 90° with respect to the horizontal surface, the frame is above the stack holding the top tissue of the stack so as to facilitate its grip to the user. This patent has the disadvantage that the adhesive means does not provide the appropriate fastening strength for lifting the wet wipes, further, the spring mechanism of the hinged frame may fail due to the mechanical fatigue of the spring.

Similarly, U.S. Pat. No. 3,248,006 and U.S. Pat. No. 4,417,670, protect inventions aimed to rigid containers with no lids for dispensing non-intertwined tissue-type products. These patents work through a hinged arm in the rear portion of the container. The arms are comprised by elongated springs having heads with adhesive means at their distal end. During normal operation, the user presses the arm down from an initial position until the head with adhesive means contacts the top tissue of the stack, lifting it towards the user when the arm returns to its initial position. Therefore, these patents have the disadvantage that the dispensing containers have no lid, so the tight sealing would not be retained in case they should contain wet wipes. Another disadvantage refers to the fact that the use of adhesive means for lifting wipes does not provide the appropriate fastening strength in the wet wipes. Finally, these patents have the disadvantage that the user must press the finger against the arms to the inside of the dispenser container, so the arms mechanism can fail because of the mechanical fatigue due to the excessive pressures from the user.

Furthermore, U.S. Pat. No. 5,810,200 describes a rigid container for tissue-type products that are continuously attached by break lines. The container has an opening which is initially covered by a detachable lid and a fastening element consisting of a flange clamped by a spring on the inner surface of the top face adjacent to the opening of the container. During use, as the user removes a tissue, the fastening element moves back until it abuts with a break line, which is perforated by the compressed spring strength so as to allow for the user to break the whole break line and remove only one tissue. Therefore, this patent would not be useful in the case of dry or wet wipes which are not continuously attached by break lines. Moreover, the detachable lid would not retain the tight sealing in case it should contain wet wipes.

Finally, US patent application US20120187140 describes a cardboard box-type container for non-intertwined tissues. The container has an opening which is initially covered by a detachable lid and a helical spring coupled at the periphery adjacent to the opening on the inner surface of the top face of the container. The function of the helical spring is to entrap the top tissue of the stack within it and hold the remaining tissues by exerting a pressure which allows to slip only the top tissue. The application has the disadvantage that the tissue product being removed could break should the helical spring pressure be too high on any part. Additionally, this invention does not have the adequate means for dispensing a single product to the user, and the detachable lid would not retain the tight seal in case it should contain wet wipes.

Thus, there is the need for a system for dispensing non-intertwined wet wipes in a rigid container. Moreover, there is the specific need that the rigid container allows for dispensing one wet wipe at a time. Finally, there is also the need to include the necessary means to tightly seal the container so that the wet wipes do not lose the liquid moisture they have.

OBJECT OF THE INVENTION

The object of the present invention is to provide a rigid container with a system for dispensing the non-intertwined wet wipes contained inside it one at a time.

Also, the object of the present invention is that the system allows for dispensing only the top wet wipe of the stack contained inside the container.

Moreover, another object of the invention is to provide the appropriate sealing means to keep the container tightly closed.

BRIEF DESCRIPTION OF THE FIGURES

The following drawings are attached to provide a better understanding of the invention.

DETAILED DESCRIPTION OF THE INVENTION

Figure 1A:
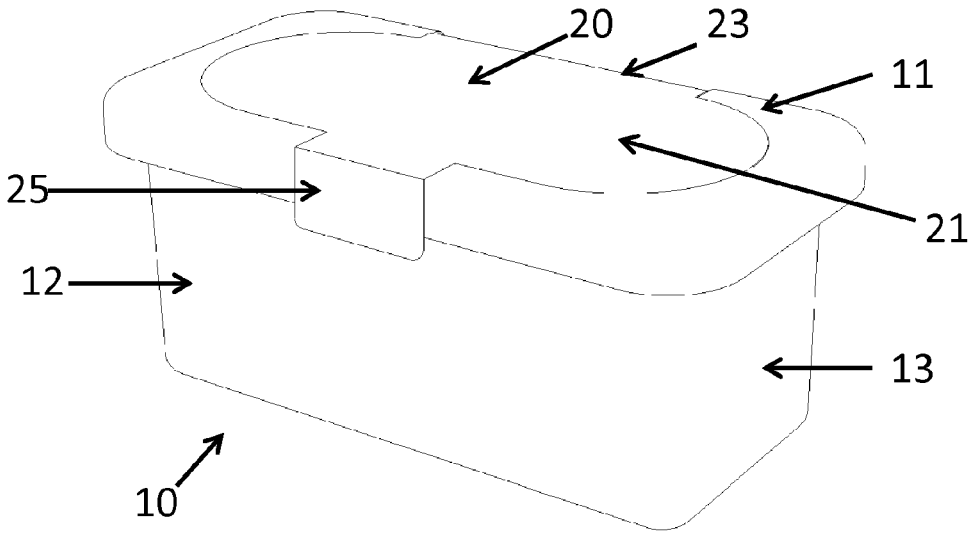
FIG. 1A is a right front top perspective view of a first arrangement of the rigid container of the system for dispensing non-intertwined wet wipes of the present invention, with the lid in the closed position.

The preferred embodiment of the present invention is better illustrated in a first arrangement of FIG. 1A and consists of a rigid container (10) with a system for dispensing, one at a time, a plurality of non-intertwined wet wipes contained within said rigid container (10). Preferably, the rigid container (10) is substantially parallelepiped-shaped with a top face (11), a front face (12), a rear face (not shown), two side faces (13) and a bottom face (not shown). The top face (11) of the rigid container (10) has a lid (20) with an outer surface (21). In the preferred embodiment, the lid (20) is attached through a hinge mechanism (23) to the top face (11) of the container and has a sealing mechanism (25) at the distal side of the hinge attachment.

Figure 1B:
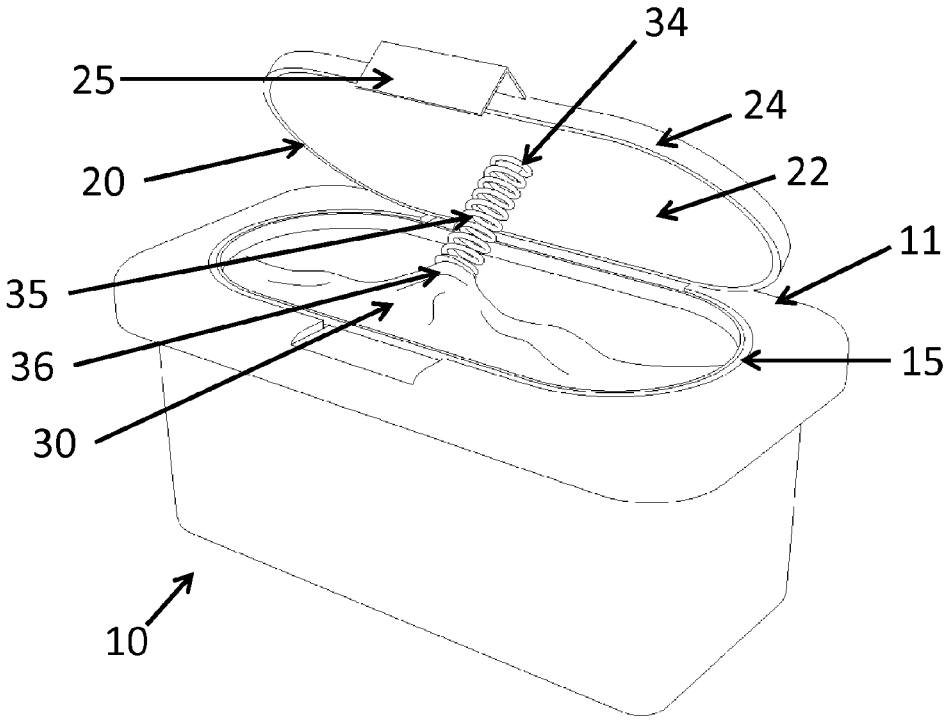
FIG. 1B is a right front top perspective view of the first arrangement of the rigid container of the system for dispensing non-intertwined wet wipes of the present invention, with the lid in the opened position, in a first embodiment.

FIG. 1B illustrates a first embodiment of the rigid container (10) with the lid (20) in the opened position, wherein the inner surface (22) of the lid is seen surrounded by a peripheral edge (24). The lid (20) tightly covers an opening (15) in the body of the top face (11) of the rigid container (10). The opening (15) allows the access to the wet wipes (30) product contained inside the rigid container (10). Further, the lid (20) has at least one fastening device on its inner surface (22). The fastening device has one end (34) permanently attached to the inner surface (22) of the lid (20) and has a mechanical element in its distant end designed to be attached to the top wet wipe (30) of the stack. In this first embodiment, the fastening device consists of a helical spring (35). Preferably, the spring (35) is attached by its upper end (34) to the central portion of the inner surface (22) of the lid (20). Preferably, the spring (35) is made of the same material as the lid (20).

Figure 1C:
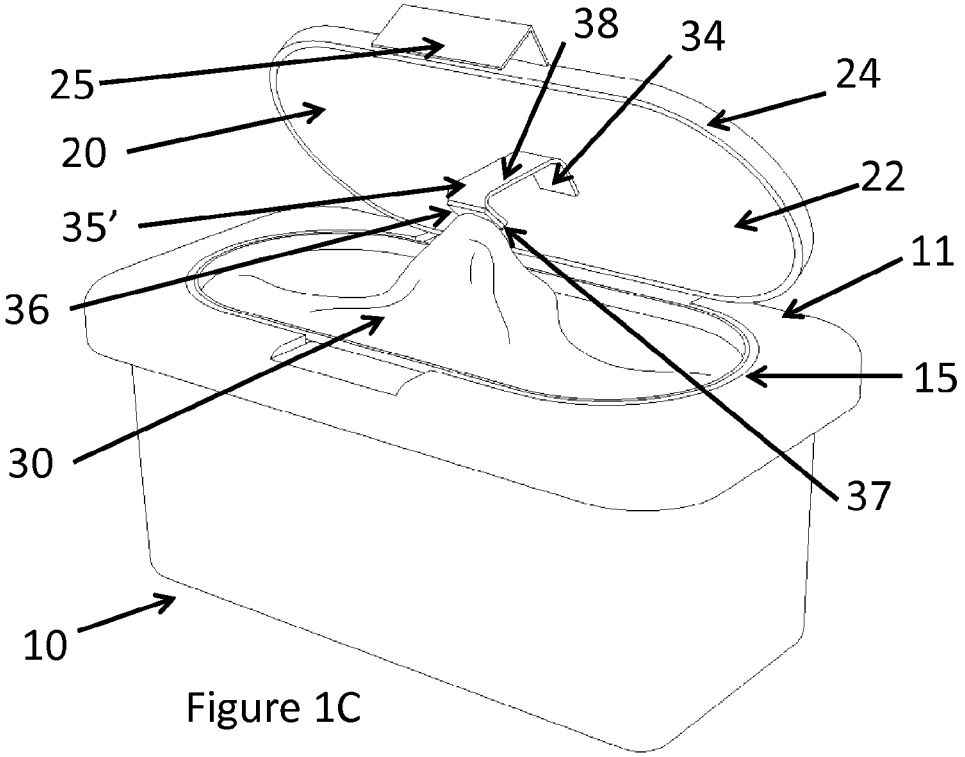
FIG. 1C is a right front top perspective view of a first arrangement of the rigid container of the system for dispensing non-intertwined wet wipes of the present invention, with the lid in the opened position, in a second embodiment.

FIG. 1C shows a second alternative embodiment of the present invention, wherein the fastening device comprises a bracket shaped "[" semi-rigid strip (35'); the strip (35') is formed by 3 sections, a top end (34), a middle section (38) and a bottom end (37), which extend one from the other. Each end has a width equal to the middle section and at least a 1 cm length. The strip (35') is attached by its top end (34) to the central portion of the inner surface (22) of the lid (20); at the lower end (37), it has a fastening mechanical element (36). Preferably, the strip (35') is made of the same material as the lid (20).

In another embodiment of the invention (not shown), the fastening device has an "L" shape, such that the top portion of the "L" is attached to the central portion of the inner surface of the lid, and the bottom portion of the "L" has the fastening mechanical element.

Figure 1D:
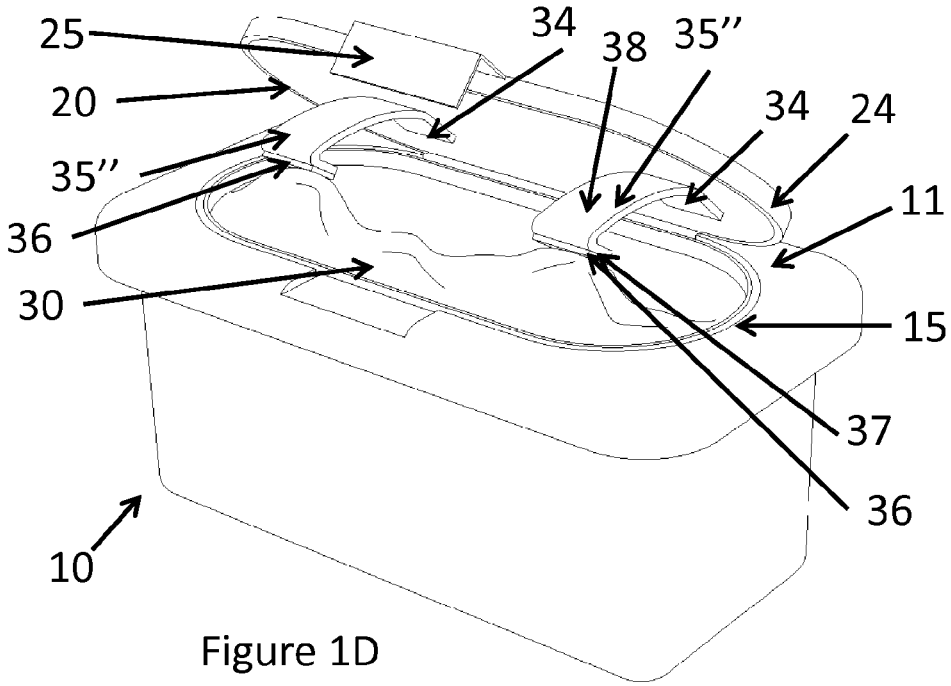
FIG. 1D is a right front top perspective view of the first arrangement of the rigid container of the system for dispensing non-intertwined wet wipes of the present invention, with the lid in the opened position, in a third embodiment.

Similarly, FIG. 1D shows a third alternative embodiment of the present invention, wherein the fastening device consists of two semi-rigid strips (35"). Preferably, each strip (35") has the same features of the strip (35'). The strips (35") are attached by their top end (34) and symmetrically distributed on the inner surface (22) of the lid (20). As in the previous embodiment, the semi-rigid strips which form the fastening device may have the "[" or "L" shape.

Figure 2A:
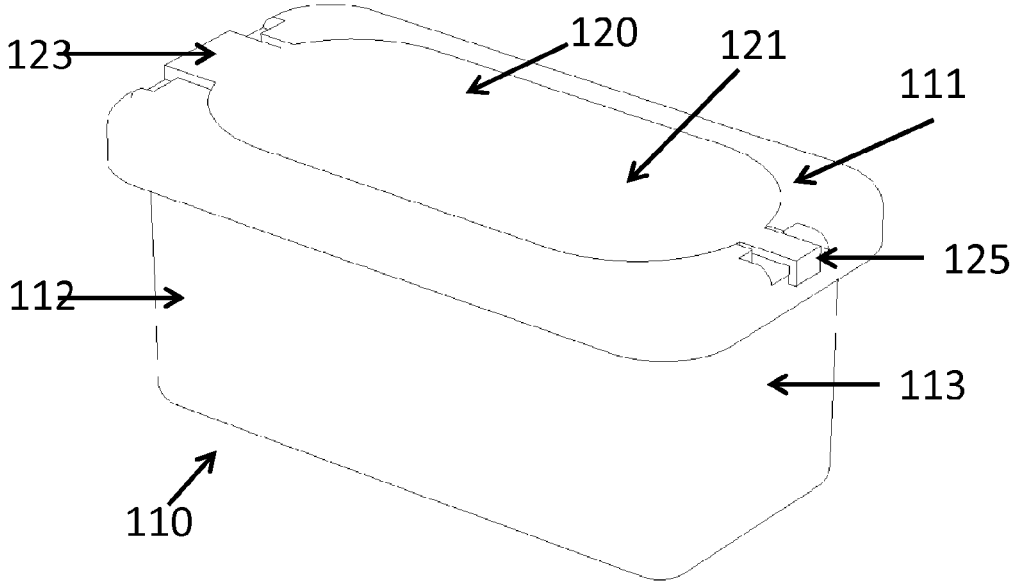
FIG. 2A is a left front top perspective view of a second arrangement of the rigid container of the system for dispensing non-intertwined wet wipes of the present invention, with the lid in the closed position.

A second arrangement of the present invention may be seen in FIG. 2A and consists of a rigid container (110) with a system for dispensing, one at a time, a plurality of non-intertwined wet wipes contained within said rigid container (110). Preferably, the rigid container (110) is substantially parallelepiped-shaped with a top face (111), a front face (112), a rear face (not shown), two side faces (113) and a bottom face (not shown). The top face (111) of the rigid container (110) has a lid (120) with an outer surface (121). In the preferred embodiment, the lid (120) is attached through a hinge mechanism (123) to the top face (111) of the container and has a sealing mechanism (125) at the distal side of the hinge attachment.

Figure 2B:
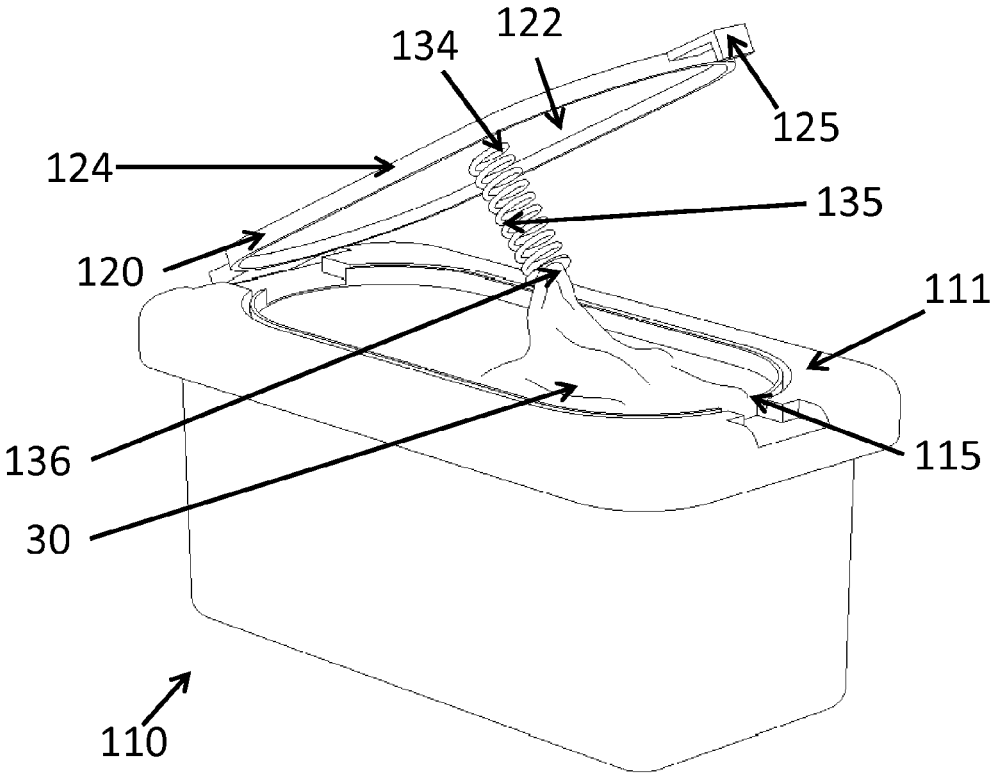
FIG. 2B is a left front top perspective view of the second arrangement of the rigid container of the system for dispensing non-intertwined wet wipes of the present invention, with the lid in the opened position, in the first embodiment.

FIG. 2B illustrates a first embodiment of the second arrangement of the rigid container (110) with the lid (120) in the opened position, wherein the inner surface (122) of the lid is seen surrounded by a peripheral edge (124). As in the first arrangement, the lid (120) tightly covers an opening (115) in the body of the top face (111) of the rigid container (110). Similarly to the first arrangement, the lid (120) has at least one fastening device on its inner surface (122). The fastening device has one end (134) permanently attached to the inner surface (122) of the lid (120) and has a mechanical element in its distant end designed to be attached to the top wet wipe (30) of the stack. In this first embodiment, the fastening device consists of a helical spring (135) of the same features described above for FIG. 1B.

Figure 2C:
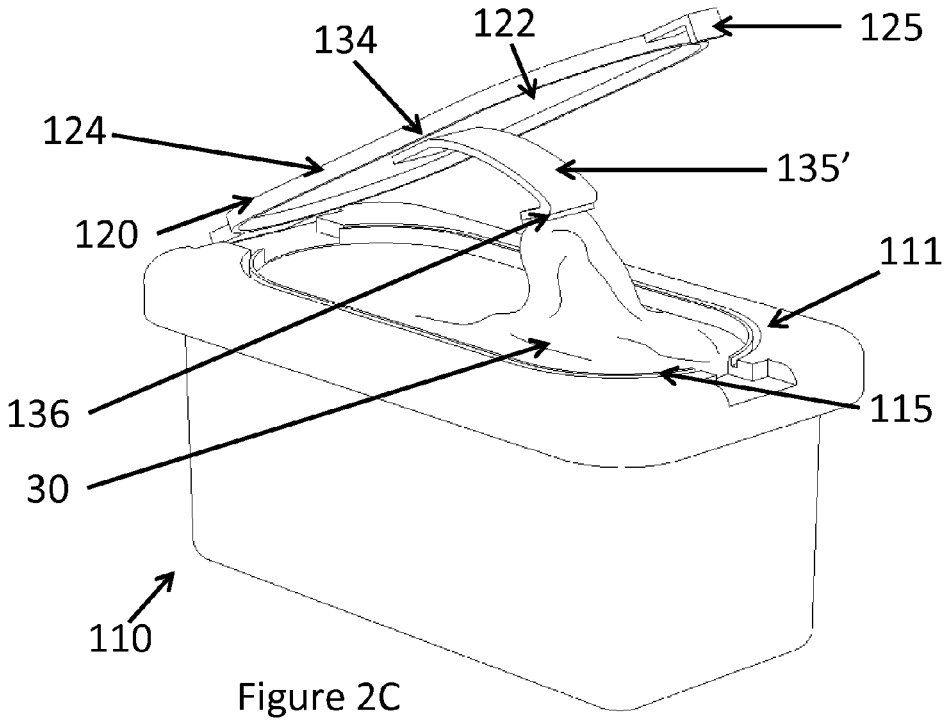
FIG. 2C is a left front top perspective view of the second arrangement of the rigid container of the system for dispensing non-intertwined wet wipes of the present invention, with the lid in the opened position, in the second embodiment.
Figure 2D:
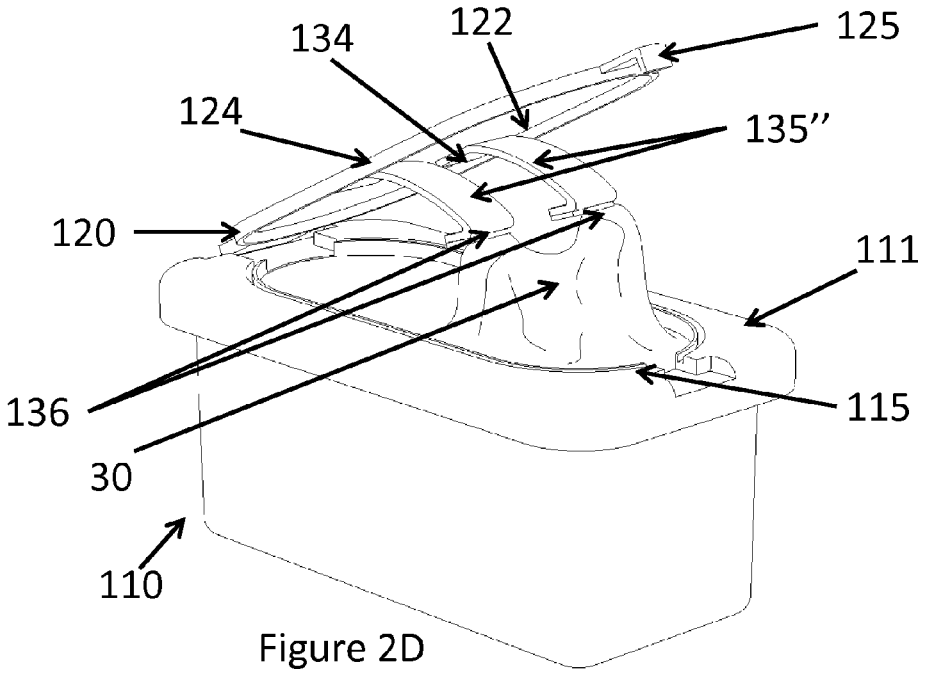
FIG. 2D is a left front top perspective view of the second arrangement of the rigid container of the system for dispensing non-intertwined wet wipes of the present invention, with the lid in the opened position, in the third embodiment.

Likewise, FIGS. 2C and 2D show the second and third embodiments, respectively, applied to the second arrangement of the rigid container (110). In these embodiments, the fastening device consists of a semi-rigid strip (135') and two semi-rigid strips (135"), respectively, of the same features as described above for FIGS. 1C and 1D, which also have a fastening mechanical element (136). In the figures, the embodiment is shown in brackets "[" shape, but the fastening device may have any other shape, such as an "L" shape.

During normal operation, the user may lift the lid (20, 120) opening the known sealing mechanism (25, 125). The fastening device moves upward and downward along with the lid (20, 120). The mechanical element at the distal end of the fastening device detachably adheres to the top wet wipe product (30) of the stack contained inside the rigid container (10, 110), so that when opening the lid (20, 120) upwards, the top wet wipe (30) is pulled up along with the lid, as shown in anyone of FIGS. 1B, 1C, 1D, 2B, 2C and 2D, for its easy removal. Subsequently, the lid (20, 120) is again positioned in the closed position of FIGS. 1A and 2A, allowing for the edge (24, 124) to tightly seal the container (10, 110), such that the fastening device falls off and rest on the top wipe of the stack, pushing it down and detachably adhering thereto. When the user needs to remove another wet wipe, he will lift again the lid (20, 120) to the opened position of FIGS. 1B, 1C, 1D, 2B, 2C and 2D, and the fastening device will pull up the top wet wipe, leaving it ready for the user to grab it by detaching it from the fastening device.

Wet wipes (30) are generally made of a non-woven material that can have different compositions, such as cellulose, cotton, rayon, polyolefins, viscose, among others. The non-woven material can be manufactured by different methods such as carding, hydroentanglement, extrusion, among others. During the manufacture of the wet wipes, the non-woven material is cut, bent, stacked and moistened with cosmetic, sanitary, cleaning and cleansing lotions, among others. As the wet wipes (30) are stacked one on top of another inside the container, a cohesive strength is created between them, which can lead to pulling two or more wipes when trying to remove one wipe from the container. On the other hand, a common feature in most of the non-woven fabric types is that there are semi-loose fibers on its surface, which may serve as the loop elements of a mechanical system of attachment known in the field as the hook and loop system or the Velcro® type system. Thus, in the described embodiments of the present invention, the mechanical element of the fastening device (36, 136), acts as the hook element of a hook and loop system. In this way, the hooks of the mechanical element attach to the loops of the top wet wipe (30) of the stack and pull it upwards when the lid (20, 120) of the container (10, 110) is opened.

Finally, as the fastening device (20, 120) to the lid of the rigid container (10, 110) is permanently attached to the lid, it goes upwards and downwards along the same each time the container is opened.

The spring type fastening device shown in FIGS. 1B and 2B is compressible such that, when uncompressed, it has a length equal to the height of the container; when the container is full of wet wipes, it is compressed by pressing on the top wipe of the stack; as the container is emptied, the spring will be decompressed until it reaches its initial uncompressed position.

Moreover, the semi-rigid strip type fastening device shown in FIGS. 1C, 1D, 2C and 2D, which is bracket "[" shaped, as well as the "L" shaped semi-rigid strip not shown embodiment, is movable, so that when the container is empty, the bottom portion of the strip touches the inferior face of the container, when same is full, the device moves upward, so that the angle between the middle section of the semi-rigid strip and the lid approaches zero and the bottom portion, which contains the mechanical element (36) presses over the wipe placed on top of the stack, as the container is emptied, the device also falls down, always exerting pressure on the wipe placed on top of the stack. When opening the cover (20, 120), the top wipe is attached to the mechanical element and rises along with the lid (20, 120) to be dispensed.

In order for this dispensing system to be effective, it is necessary that the bond strength of the mechanical element (36, 136) to the non-woven fabric of the top wet wipe (30) is greater than the cohesion strength between the wipes. Therefore, the mechanical element must have a bond strength to the non-woven fabric of the wet wipes that is 20% greater than the cohesion strength between the stacked wet wipes. According to the measurement tests performed on several commercial wet wipes products, it was determined that the average cohesion strength between the wet wipes ranges between 100 and 240 grams, therefore, the mechanical element shall produce a fastening strength with the top wet wipe, depending on the cohesive strength of the wipes contained within the container, between 120 and 290 grams. In order to obtain the operationally suitable bond strength within this range, the material and arrangement of the fastening device may be modified; and also the shape, height, density and space among the hooks of the mechanical element.

Based on the above disclosure, certain embodiments and details have been described in order to illustrate the present invention, and it will be obvious for those skilled in the art that variations and modifications may be made without departing from the scope of the present invention.

The invention claimed is:

1. A rigid container for non-woven fabric wet wipes, that is substantially parallelepiped-shaped with a top face, a front face, a rear face, two side faces and a bottom face, the container has a stack of non-intertwined wet wipes inside, and that has an opening on its top surface covered by a lid attached to the top face of the container by a hinge mechanism; characterized by:

the lid has at least one fastening device on an inner surface of the lid, the fastening device consists of a bracket "[" shaped semi-rigid strip conformed by 3 sections: a top section, a middle section and a bottom section; wherein the top section forms the first end of the fastening device and the bottom section, which is an extension of the middle section, forms the second end of the fastening device comprising fastening mechanical elements, wherein the fastening device has a first end permanently attached to, and without an ability to pivot in relation to, the inner surface of the lid and a second end, which has fastening mechanical elements designed to be attached to the fibers of the non-woven fabric that comprise the wet wipes of the stack; wherein the fastening mechanical elements are formed by hooks of a hook and loop system.

2. The rigid container for dispensing wet wipes according to claim 1, wherein the lid tightly covers the opening of the top surface of the rigid container.

3. The rigid container for dispensing wet wipes according to claim 1, wherein the fastening device is made of a first material and the lid is made of a second material, wherein the first material and the second material are the same.

4. The rigid container for dispensing wet wipes according to claim 1, wherein the semi-rigid strip is attached by the top section thereof to the central portion of the inner surface of the lid.

5. The rigid container for dispensing wet wipes according to claim 1, wherein the fastening device consists of two bracket shaped semi-rigid strips consisting of 3 sections: a top section, a middle section and a bottom section; such that the top section forms the first end of the fastening device and the bottom section forms the second end of the fastening device.

6. The rigid container for dispensing wet wipes according to claim 5, wherein the semi-rigid strips are symmetrically distributed on the inner surface of the lid.

7. The rigid container for dispensing wet wipes according to claim 1, wherein the wet wipes and the mechanical element have a bond strength which is greater than the cohesion strength between the wet wipes.

8. The rigid container for dispensing wet wipes according to claim 1, wherein a bond strength between the wet wipes and the mechanical element is 20% higher than a cohesion strength between the stacked wet wipes.

9. The rigid container for dispensing wet wipes according to claim 1, wherein a bond strength between the wet wipes and the mechanical element ranges between 120 and 290 grams.

10. The rigid container for dispensing wet wipes according to claim 1, wherein the fastening device has a length configured such that once the fastening device is attached to the lid, the fastening device touches the bottom surface of the rigid container.

11. The rigid container for dispensing wet wipes according to claim 1, wherein the wet wipes are moistened with at least one of cosmetic, sanitary, cleaning and cleansing lotions.

12. The rigid container for dispensing wet wipes according to claim 1, wherein the material and arrangement of the fastening device may be modified.

13. The rigid container for dispensing wet wipes according to claim 1, wherein the mechanical element may be modified in shape, height, density and space.

* * * * *